US006281777B1

(12) United States Patent
Aufleger et al.

(10) Patent No.: US 6,281,777 B1
(45) **Date of Patent: *Aug. 28, 2001**

(54) INDUCTIVE COMPONENT FOR THE ATTENUATION OF COMMON MODE AND PUSH-PULL INTERFERENCE

(75) Inventors: Peter Aufleger, Herbrechtingen; Herbert Baschke, Syrgenstein, both of (DE)

(73) Assignee: Siemens Matsushita Components GmbH & Co. KG, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/779,371

(22) Filed: Jan. 6, 1997

(30) Foreign Application Priority Data

Jan. 5, 1996 (DE) ..... 196 00 308

(51) Int. Cl.[7] ..... H01F 38/20
(52) U.S. Cl. ..... 336/175; 336/174; 333/177
(58) Field of Search ..... 336/172, 174, 336/175, 178, 212; 333/12, 177, 181, 185

(56) References Cited

U.S. PATENT DOCUMENTS

| | | | | |
|---|---|---|---|---|
| 1,722,167 | * | 7/1929 | Wilson | 336/172 |
| 1,814,225 | * | 7/1931 | Neiss | 336/175 |
| 2,283,711 | * | 5/1942 | Welch, Jr. | 336/172 |
| 2,810,901 | * | 10/1957 | Crane | 336/172 |
| 3,134,950 | | 5/1964 | Cook . | |
| 3,146,393 | * | 8/1964 | Gibbon | 336/172 |
| 3,449,704 | * | 6/1969 | Matsushima et al. | 336/175 |
| 3,550,099 | * | 12/1970 | Stein | 336/175 |
| 4,259,716 | * | 3/1981 | Harris et al. | 336/172 |
| 5,023,577 | | 6/1991 | Drake . | |
| 5,220,297 | * | 6/1993 | Crowhurst | 336/175 |
| 5,243,308 | | 9/1993 | Shusterman et al. . | |
| 5,321,373 | * | 6/1994 | Shusterman et al. | 333/181 |
| 5,392,017 | | 2/1995 | Munoz et al. . | |

FOREIGN PATENT DOCUMENTS

| | | |
|---|---|---|
| 420 295 | 9/1966 | (CH) . |
| 44 21 986 A1 | 1/1904 | (DE) . |
| 94 20 609.0 | 3/1923 | (DE) . |
| 29 057 | 4/1954 | (DE) . |
| 1 723 575 | 10/1955 | (DE) . |
| 1 174 858 | 7/1964 | (DE) . |
| 1 266 378 | 4/1968 | (DE) . |
| 2 119 950 | 11/1972 | (DE) . |
| 2 258 672 | 6/1974 | (DE) . |
| 27 07 211 C2 | 8/1978 | (DE) . |
| 38 40 523 A1 | 6/1990 | (DE) . |
| 41 37 685 A1 | 5/1992 | (DE) . |
| 43 11 124 A1 | 10/1994 | (DE) . |
| 43 11 126 A1 | 10/1994 | (DE) . |
| 44 12 749 A1 | 10/1995 | (DE) . |
| 851 814 | 10/1960 | (GB) . |

OTHER PUBLICATIONS

IBM Technical Disclosure Bulletin, Bauer et al, "Magnetic Multipath Logical Component", vol. 1, No. 4, Dec. 1958, pp. 32, 33, 336–172.*

German Utility Modell No. 94 20 609.0 (Hirschmann) dated Mar. 23, 1995.

Patent Abstracts of Japan, No. 3–99409 (Akira), dated Apr. 24, 1991.

* cited by examiner

*Primary Examiner*—Anh Mai
(74) *Attorney, Agent, or Firm*—Herbert L. Lerner; Laurence A. Greenberg; Werner H. Stemer

(57) ABSTRACT

An inductive component for the attenuation of common mode and push-pull interferences in n-lead systems with n≧2 leads, includes a body of a permeable material having n bores formed therein. Electric leads are disposed in the bores.

5 Claims, 1 Drawing Sheet

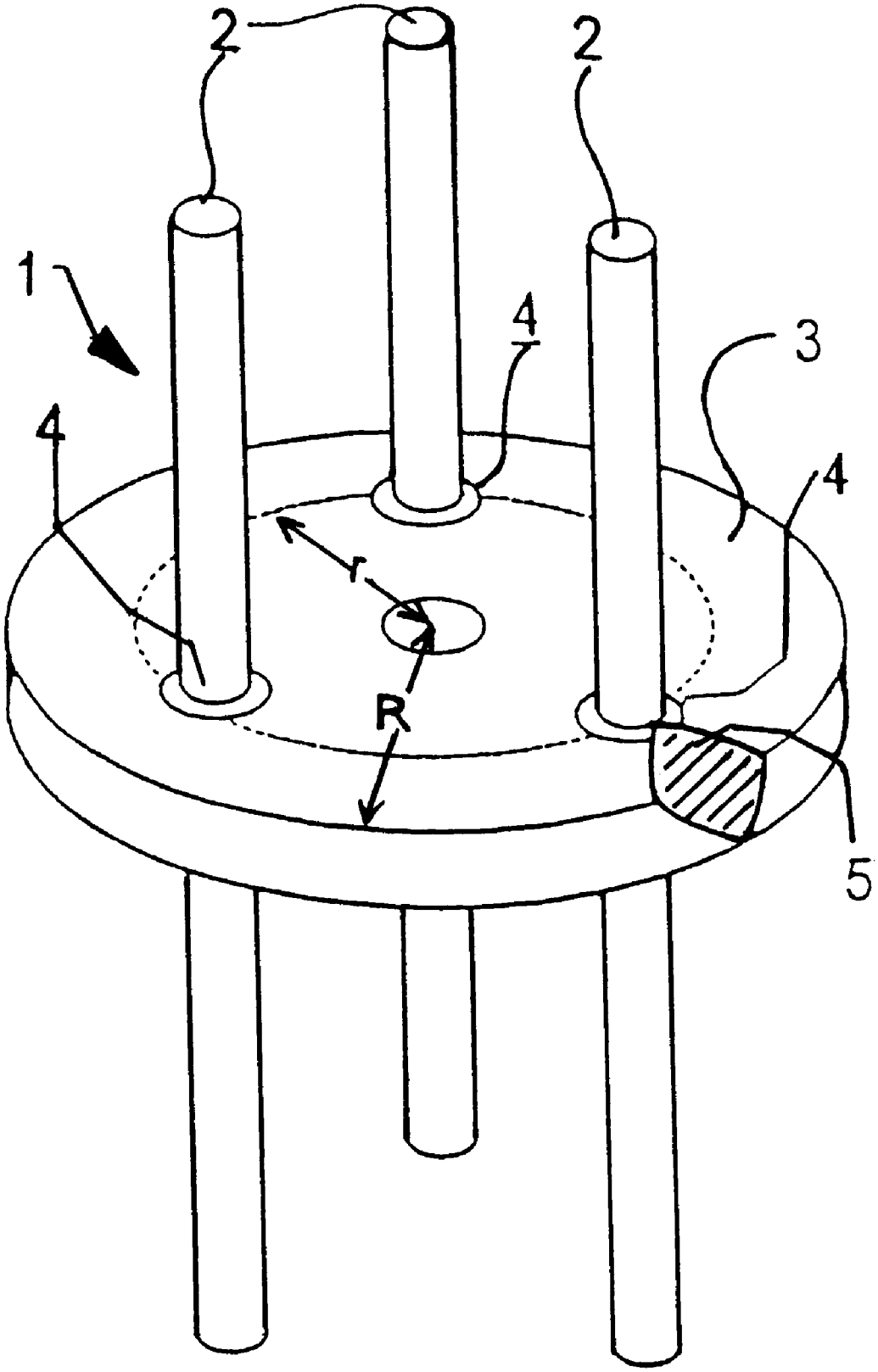
2
2
1
4
3
4
4
r
R
5

INDUCTIVE COMPONENT FOR THE ATTENUATION OF COMMON MODE AND PUSH-PULL INTERFERENCE

BACKGROUND OF THE INVENTION

Field of the Invention

The invention relates to an inductive component for the attenuation of common mode and push-pull interferences in n lead systems with n≧2 leads.

The propagation ratios of lead-bound interference must be considered when dimensioning EMC filters (electromagnetic compatibility). One must also differentiate between common mode and push-pull interference.

Push-pull interference propagates only along the connected leads, whereby in a two-lead system the interference current moves along one lead in the direction of potentially susceptible equipment while moving along the other lead back toward the interference source. The two interference currents are in push-pull and therefore such interference is called push-pull or symmetrical interference.

Parasitic capacitances in the interference source and potentially susceptible equipment or intentional connections to ground also result in an interference current in the ground loop. The interference current flows along the leads to the potentially susceptible equipment and flows back through the ground leads. The interference currents on the leads are in common mode, thus such interference is called common mode interference or asymmetrical interference.

Current-compensated inductors are used to attenuate asymmetrical interference. However, those inductances are not suitable for the attenuation of symmetrical interference, since the required leakage inductance is very low (≦1% of the asymmetric components). In order to compensate for that ineffectiveness against symmetrical interference, additional inductances which are effective against symmetrical interference are employed. Examples include bar or toroidal core inductors with very low inductance due to the use of low-permeability cores. However, such solutions are relatively expensive. The power loss of such systems is also rather high.

SUMMARY OF THE INVENTION

It is accordingly an object of the invention to provide an inductive component for the attenuation of common mode and push-pull interference, which unifies component parts for the interference suppression of symmetrical and asymmetrical interferences in one component to be used for the interlocking of n≧2) leads, which can be inexpensively manufactured and which exhibits low intrinsic losses.

With the foregoing and other objects in view there is provided, in accordance with the invention, an inductive component for the attenuation of common mode and push-pull interferences in n-lead systems, comprising a body of a permeable material having n bores formed therein; and n≧2 electric leads disposed in the bores.

In accordance with another feature of the invention, the body is symmetrical about a center axis of the body. In accordance with a further feature of the invention, the bores are symmetrical to an axis of the body.

In accordance with an added feature of the invention, the body is formed of a highly permeable material. In accordance with an additional feature of the invention, the body is in the form of a disk.

In accordance with yet another feature of the invention, the body has at least one air gap formed therein. In accordance with yet a further feature of the invention, the at least one air gap is shunted.

In accordance with yet a further feature of the invention, there is provided a number of windings per unit length of the lead being ≧1. In accordance with yet an added feature of the invention, the individual leads have different numbers of windings per unit length.

In accordance with yet an additional feature of the invention, the body is assembled of materials with different permeabilities. In accordance with again another feature of the invention, there is provided at least one other body, the bodies being disposed one behind the other. In accordance with a concomitant feature of the invention, the bodies are formed of different materials.

Other features which are considered as characteristic for the invention are set forth in the appended claims.

Although the invention is illustrated and described herein as embodied in an inductive component for the attenuation of common mode and push-pull interference, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIG. 1 of the drawing is a diagrammatic, perspective view of an inductive component according to the invention.

DESCRIPTION OF THE PREFERRED EMBODIMENTS

Referring now in detail to the single figure of the drawing, there is seen an inductive component 1 for interference suppression of a three-phase current with 120° phase displacement and three leads or lines 2.

The inductive component 1 includes a body in the form of a disk 3 with a radius R of a permeable, preferably highly permeable material. The disk 3 contains bores 4 that are distributed along a radius r and through which the electric leads or conductors 2 are passed. The bores 4 are offset 120° from one another and therefore the sum of the currents of the leads 2 is zero. A compensation of the magnetic flux generated by the operating current is thus provided through the use of this configuration. This permits the use of highly permeable materials with very low saturation limits, resulting in very high inductances at high rated currents.

In an outer region 5 (R-r), the inductive component 1 acts similarly to a current-compensated inductor with a high asymmetrical inductance, as a function of the radii R, r and the thickness of the disk 3. The resulting symmetrical inductance can be influenced by the shape of the disk 3, as well as the nature, position and number of the bores 4. The addition of at least one air gap raises the saturation limit of the symmetrical inductance, as well as allowing a further increase in rated current. The position, configuration and number of air gaps are used to adapt the component to the widest variety of requirements. New air gaps can be created by shunting an existing air gap.

The inductive component according to the invention can be used in AC and DC power supply systems with the widest variety of harmonics and waveforms as well as current and voltage pulses for the attenuation of common mode and push-pull interference. When used in filters, it is suitable for interlocking leads for a frequency range of a few kHz to several GHz. Operating current strengths range from a few mA into the kA range. In this case, the inductances employed for interference suppression as direct-axis elements in the interference suppression circuits must exhibit low intrinsic losses.

It is possible to manufacture spatially small, low-loss and cost-effective interference suppression components meeting the widest variety of requirements for providing interference suppression for devices, installations and systems, by variably adjusting, configuring and realizing the inductive component according to the invention.

Variants of the inductive component described above include those having ≧1 turns per unit length or different numbers of turns per unit length (among the individual leads). The component can be further adapted to the requirements of the specific application by the selection of different materials (permeability), placement and number of bores, configuration and number of air gaps and/or a combination of various materials. Other possibilities are cascading (e.g. increasing the inductance by placing multiple and even different disks behind one another) and connecting disks with various configurations to a common lead. Filters for applications in the MHz range can be realized by combination with a multi-bushing capacitor disclosed in German Published, Non-Prosecuted Patent Application DE 43 11 124 A1.

The body can have a form other than the form of the disk body shown in this embodiment example (e.g. cylindrical, prismatic, etc.). The configuration is determined by the requirements of the application and possibly the number n of leads. For example, the cross-section of the body may be ellipsoid or oval with two leads, rectangular with four leads, pentagonal with five leads and hexagonal with six leads.

We claim:

1. An inductive common mode and differential mode noise attenuator, comprising:

a disk-shaped body of a permeable material having an axis, a given thickness, and n≧2 bores formed therethrough, said n≧2 bores running along said given thickness of said body and being symmetrical to said axis of said body, each of said n≧2 bores containing at most one of n≧2 electric leads, and each of the n≧2 electric leads projecting through said body once in a respective one of said n≧2 bores.

2. The inductive component according to claim 1, wherein said body is symmetrical about a center axis of said body.

3. The inductive component according to claim 1, wherein said body is in the form of a disk.

4. The inductive component according to claim 1, wherein said body is formed of a highly permeable material.

5. In combination with a system having n≧2 electric leads, an inductive common mode and differential mode noise attenuator, comprising:

a disk-shaped body of a permeable material having an axis, a given thickness, and n≧2 bores formed therethrough, said n≧2 bores running along said given thickness of said body and being symmetrical to said axis of said body, each of said n≧2 bores containing at most one of the n≧2 electric leads, and each of the n≧2 electric leads projecting through said body once in a respective one of said n≧2 bores.

* * * * *